US005515900A

United States Patent [19]

West et al.

[11] Patent Number: 5,515,900

[45] Date of Patent: May 14, 1996

[54] COLLAPSIBLE ARRAY OF PANELS AND A FOLDING DISPLAY MADE THEREOF

[76] Inventors: William G. West, 5225 Due West Rd., Powder Springs, Ga. 30073; John T. Kidd, 2067 A Lake Park Dr., Smyrna, Ga. 30080

[21] Appl. No.: 242,270

[22] Filed: May 13, 1994

[51] Int. Cl.[6] ..... A47G 5/00

[52] U.S. Cl. ..... 160/135; 160/230

[58] Field of Search ..... 160/135, 230, 160/231.1, 231.2, 405, 351, 352; 52/239; 40/155, 610, 605, 606

[56] References Cited

U.S. PATENT DOCUMENTS

| | | | |
|---|---|---|---|
| Re. 30,777 | 10/1981 | Ytter . | |
| 956,252 | 4/1910 | Wilson . | |
| 3,113,392 | 12/1963 | Downing | 40/605 |
| 3,562,973 | 2/1971 | Gangemi | 160/135 |
| 3,913,656 | 10/1975 | Guyer | 160/135 |
| 4,185,430 | 1/1980 | Gartung | 52/239 |
| 4,275,520 | 6/1981 | Appleton et al. . | |
| 4,372,086 | 2/1983 | Hanlon . | |
| 4,531,564 | 7/1985 | Hanna | 160/351 |
| 4,561,229 | 12/1985 | Gartung | 52/239 |
| 4,711,046 | 12/1987 | Herrgord . | |
| 4,722,146 | 2/1988 | Kemeny . | |
| 4,794,712 | 1/1989 | Wood | 40/605 |
| 4,977,696 | 12/1990 | Johansson | 160/135 |
| 5,115,855 | 5/1992 | Lindblom et al. | 160/135 |
| 5,131,448 | 7/1992 | Miller | 160/135 |
| 5,220,952 | 6/1993 | Beaulieu | 160/135 |
| 5,323,836 | 6/1994 | Tuttle et al. | 160/135 |

*Primary Examiner*—David M. Purol
*Attorney, Agent, or Firm*—Jones & Askew

[57] ABSTRACT

An array of panels foldably connected such that the array may be collapsed into a single stack of panels, and a method of manufacturing such an array. The array has at least three rows of panels, where the first and second rows have at least two panels and the third row has at least one panel. The panels in each row are foldably connected so that each row of panels may be collapsed into a single stack of panels. Each row of panels is connected to the row of panels below it so that the individual stacked rows may be further collapsed onto each other to form a single stack of panels. With this folding scheme, the array may have more than two panels in each row and may have more than three rows of panels. The panels define connecting pin channels that, when the panels are unfolded, are co-axially aligned with connecting pin channels of adjacent panels. Connecting pins are inserted into the co-axially aligned connecting pin channels to hold panels in a specific orientation with respect to each other. Further, the outer edges of the panels define indentations and prong receptacles formed within the indentations. Retainers are inserted into these indentations and prong receptacles to hold the panels in a specific orientation with respect to each other.

25 Claims, 14 Drawing Sheets

A

COLLAPSIBLE ARRAY OF PANELS AND A FOLDING DISPLAY MADE THEREOF

TECHNICAL FIELD

The present invention relates generally to collapsible panel systems. More specifically, the present invention relates to an array of interconnected panels that may be collapsed into a single stack of panels.

BACKGROUND OF THE INVENTION

Flat planar structures have numerous applications and are found in all walks of life. Often, these structures are too large and too heavy for one person to conveniently move from place to place. Such structures include visual displays of the type used to make pitches at business meetings, to attract prospective customers at trade shows or business conventions, to present educational matter in a classroom or lecture hall setting, and to effectively communicate information in numerous other situations.

Companies often spend large amounts of money on large visual displays for such meetings, shows and conventions. As these displays are often heavy, often consist of several parts and often contain complicated mechanical support structures, carpenters, electricians and other skilled labor may be needed to assemble and disassemble the equipment.

While these types of displays are effective in conveying information, size, cost and assembly and disassembly requirements often make such equipment cost prohibitive for many individuals who require such a display for business or educational purposes. An effective yet smaller scale lightweight display that can be disassembled, transported and re-assembled by an individual is desirable in many situations. For example, if one must give a presentation on Monday in New York and again on Tuesday in San Francisco, one needs the ability to disassemble such a display, transport it himself or herself without the need for a commercial carrier or delivery service, and easily re-assemble the display prior to the next presentation without the need for hiring skilled labor. Similarly, if one must make a classroom presentation requiring charts or other visual aids, one needs the ability to disassemble a display containing such visual aids, easily carry it himself or herself across campus, and quickly and easily re-assemble the display prior to the beginning of, or during, class.

Various displays have been developed to address these needs. For example, U.S. Pat. No. 4,275,520 to Appleton, et al., relates to a modular panel system, comprised of at least four plastic foam core type panel sections, that disassembles for easy transportation. The panel sections fit together to form a single large panel for display purposes. The panel sections are held together by outer periphery support members around the perimeter of the large panel and by support panels in the rear of the large panel. Each rear support panel is fastened to a group of four abutting panel sections to fasten the group together.

U.S. Pat. No. 4,372,086 Hanlon relates to a segmented display mechanism having first and second display panels of lightweight sheet material. Each of these display panels is divided by vertical folds into a plurality of vertical planar sections. These sections lie in different vertical planes so that the top and bottom edges of each of the first and second display panels extend along a zig-zag path. This zig-zag path allows the first display panel to be supported on a flat supporting surface along its bottom edge. Similarly, the second display panel is supported by the lower first display panel. The bottom portions of some of the sections of the second panel intersect the upper portions of some of the sections of the first panel. This intersection is accomplished through vertical slots in the tops of the first panel sections and vertical slots in the bottoms of the second panel sections. The slots are vertically aligned so that the intersecting sections of the first and second panels interlock against movement in a horizontal direction and provide stability to the display. A third top display panel may be supported by the second display panel in similar fashion.

U.S. Pat. No. 4,711,046 to Herrgord relates to a lightweight display with upper and lower display sections. Each of the upper and lower display sections has a plurality of individual panels. These individual panels are joined together by flexible plastic hinges and are completely covered with a flexible sheet material so as to form a continuous surface over the multipanel display section. The upper and lower display sections are interconnected by a stiff spline that is inserted downwardly in a slot in the top edge of each panel in the lower display section. The upper edge of the spline then fits upwardly into a slot in the bottom edge of each of the panels in the upper display section.

U.S. Pat. No. 4,722,146 to Kemeny relates to a portable display unit with a plurality of panels connected through hinges along adjacent vertical sides. The hinges include flexible ribbons that extend between opposite faces of adjacent panel units. Upper and lower panel units of the panel display device are interconnected by a plurality of fasteners. One fastener is located on the top of each of the panel units in the lower display unit and fits matingly into the bottom of each panel unit of the upper display unit.

However, certain drawbacks exist with the aforementioned displays. For example, Appleton, et al. relates to a display in which the individual panel sections are held together by support panels in the rear of the large panel. Thus, when the display is disassembled, the individual panel sections must be separately packed for storage and transportation. If material is printed on the fronts of the individual panels, the task of re-assembling the display correctly becomes more difficult and more time-consuming, as each individual panel must be correctly positioned during assembly. Further, because the individual panels are not permanently connected, there is an increased tendency for the individual panels to become lost or damaged. Also, the rear support panels represent additional pieces of equipment that must be stored. These additional pieces of equipment add to the space needed to store the display, making such a multipart display even more difficult to disassemble, transport and re-assemble.

Hanlon describes a display in which separate interconnected rows of panels are stacked upon one another in a non-planar manner to prevent movement of the rows of panels in a horizontal direction and to provide stability to the display. However, such a display is limiting in that if one desires a flat, planar surface for use as a backdrop display, such a surface would not be possible with the configuration in Hanlon. Further, assembly and disassembly is made difficult because each row, while being capable of being collapsed to a stack of panels having the width of one panel, must be unfolded and placed in slots in the tops of the panels in the row below. Thus, if an individual had to unfold a row consisting of several panels and then place the row of panels in the appropriate slots while holding the entire row, the task would become burdensome and difficult. Such a display may also not be as aesthetically pleasing as other displays, due to the visible slots required in the tops of the supporting row or rows of panels.

As with the display in Hanlon, the displays in Herrgord and Kemeny each have a lower row of interconnected panels joined to an upper row of interconnected panels. It may be difficult for an individual using a display described in Herrgord or Kemeny to align the connectors of the panels in the upper row with the corresponding mating connectors of the panels in the lower row while simultaneously holding the upper row of panels. Further, in Herrgord, the continuous surface of the flexible sheet of material is typically a fabric affixed to the panels which adds to the difficulty of assembling and disassembling the display. The flexible ribbons that extend between opposite faces of adjacent panel units in Kemeny add to the difficulty in assembling and disassembling such a display, as the ribbons would tend to get in the way as one attempted to fit the top panels onto the fasteners on the lower panels.

Providing a collapsible display in which each panel in the display is integrally connected to at least one other panel in the display is desirable for ease of assembly and disassembly of the display. A display constructed in such a manner avoids many of the drawbacks associated with above-mentioned references in that the display, even if collapsed, still remains a single unit. This feature allows for the display to be disassembled and assembled and keeps the individual panels from having to be separated from one another during storage and transportation. However, the individual panels of such a display must be foldably connected in a manner that still allows the display to be collapsed into a compact stack of panels that is easy for an individual to carry onto a plane, pack in a car or otherwise transport without the need to ship it via commercial carrier.

Such a display is described in U.S. Pat. No. Re 30,777 to Ytter. Ytter describes a portable display system having vertically stacked panel assembly groups comprised of an array of panel assemblies. Two panel assembly groups are shown hinged together to form an array of panel assemblies two high by four across. The resulting display system can open and close in accordion-like fashion. With the exception of an inverted "T" at the top center of the 2×4 array, the panel assemblies are hinged where their edges meet. This allows the display system to be collapsed to produce a stack of panel assemblies with a frontal dimension of one panel assembly.

As noted in Ytter, the display in the preferred embodiment consists of two panel assembly groups each consisting of a 2×2 matrix of panel assemblies. Although Ytter suggests that more than two panel assembly groups may be used, it does not disclose a folding display having a height greater than two panel assemblies. Furthermore, the arrangement of hinged and separated edges taught by Ytter does not lend itself to a taller array of panel assemblies. Thus, the folding scheme taught by Ytter may be limiting in applications requiring a collapsible display having a height of more than two panels.

Thus, there is a need in the art for a planar array of panels interconnected in a manner that allows the array to be collapsed into a single stack of panels, regardless of the number of panels in each row or the number of rows of panels in the array, to facilitate ease of disassembly, transportation, and reassembly.

SUMMARY OF THE INVENTION

As will be seen, the present invention overcomes the aforementioned drawbacks associated with the prior art.

Generally described, the present invention provides an array of panels foldably connected in a manner that allows the array to be collapsed into a single stack of panels, regardless of the number of panels in each row or the number of rows of panels in the array. The panels are interconnected in a manner that facilitates ease of disassembly, transportation and/or assembly of the array. An array interconnected in such a manner may be utilized in a wide variety of applications.

The present invention provides a collapsible array having first, second and third rows of foldably connected panels. The panels in each of these rows are foldably connected in a manner permitting each of the rows of panels to be folded to form a single stack of panels. The leftmost panel of the first row is foldably connected to the leftmost panel of the second row and the rightmost panel of the second row is foldably connected to the rightmost panel of the third row, thereby allowing the folded stacks of panels of the first, second and third rows to be folded together to form a single stack of panels.

Additionally, the collapsible array in this embodiment may have a fourth row of panels foldably connected to each other in a manner permitting the panels to be folded to form a single stack of panels. The leftmost panel of the third row of panels is foldably connected to the leftmost panel of the fourth row in a manner permitting the first, second, third and fourth rows of panels to be folded into a stack of panels.

The present invention may further provide a plurality of additional rows of folding panels, with each row having either a leftmost panel or rightmost panel foldably connected to a leftmost panel or rightmost panel in the row below such that all rows of panels in the collapsible array may be folded into a single stack of panels. Each of the rows of panels in the array may further have one or more panels foldably connected between the leftmost and rightmost panels in the rows. The present invention may further provide for additional panels foldably connected to the leftmost panel and/or the rightmost panel of at least one of the rows of panels. In the preferred embodiment, the rows of panels in the array may be collapsed into a single stack of panels having a frontal dimension of one panel.

When unfolded, the array of panels can be arranged to be self-supporting in an upright position. Alternately, stabilizing pins or fasteners may be provided. Each of the panels in the collapsible array has a front surface, a rear surface, and peripheral edge surfaces. The edge surfaces of adjacent panels preferably each define at least one connecting pin channel that, when the adjacent panels are unfolded, is co-axially aligned with the connector pin channel of adjacent panels. A plurality of pins are then provided for insertion into the coaxially aligned connecting pin channels of the adjacent panels to hold the adjacent panels in a specific orientation with respect to each other. Further, prong receptacles may be defined along with indentations in outer edge surfaces of at least two of the panels. A plurality of retainers each having a back plate and at least two prongs extending from the back plate are insertible into indentations and the prong receptacles to hold the panels in a specific orientation with respect to one another. Or, clips may be fastened along the periphery of the array to maintain the array in a planar configuration.

In manufacturing a preferred form of the present invention, a sheet of material having a core layer, a top foldable layer and a bottom foldable layer is provided. The sheet of material is cut to form a first row of panels, a second row of panels and a third row of at least one panel. The first and second rows of panels each comprise a leftmost panel and a right panel. The second row of panels is located above the first row of panels, with the leftmost panel in the first row being foldably connected to the leftmost panel of the second row. The third row of panels is located above the second row of panels, with the rightmost panel in the second row being foldably connected to the rightmost panel in the third row. The rows may be folded into a single stack of panels.

Described in more detail, the material is cut in alternating fashion through the top layer and the core layer and then through the bottom layer and the core layer in the first row and likewise in the second row to form a plurality of panels capable of being folded into a single stack of panels. Further, the sheet of material may be cut to form a fourth row of foldably connected panels located above the third row, with the leftmost panel in third row being foldably connected to the leftmost panel in the fourth row. The sheet of material may also be cut to form a plurality of rows of foldably connected panels located above the fourth row, with the leftmost panel or the rightmost panel in each row being foldably connected to the corresponding leftmost panel or rightmost panel from the row below. The plurality of rows of panels are cut to be capable of being folded together to form a single stack of panels. If the panels are of uniform size, the plurality of rows of panels may be capable of being folded together to form a single stack of panels having a frontal dimension of one panel.

Further, connector pin channels, as described above, may be formed in the core layer in a plurality of panels to allow the individual panels to be held together, by the insertion of connecting pins. The pins are inserted when the panels are unfolded such that connecting pin channels of adjacent panels are coaxially aligned. Indentations may also be formed in the outer edges of the panels, with prong receptacles being formed therein. A plurality of retainers, each having a back plate and at least two prongs extending therefrom, may then be inserted to hold the panels in a specific orientation with respect to one another.

An array of panels may alternatively be manufactured by providing first, second and third rows of individual panels. Adjacent panels in each row are then hinged together. The leftmost panel of the first row is then hinged to the leftmost panel of the second row. The rightmost panel of the second row is then hinged to the rightmost panel of the third row. The hinges are operable such that the panels in the first, second and third rows may be folded into a single stack of panels.

Thus, it is an object of the present invention to provide an interconnected collapsible array of panels.

It is further an object of the present invention to provide an array of panels consisting of multiple rows of foldably connected panels that may be collapsed into a single stack of panels.

It is a further object of the present invention to provide an array of panels that may be collapsed into a single stack of panels, regardless of the number of panels in each row or the number of rows of panels in the array.

It is a further object of the present invention to provide an array of panels that may be easily collapsed, transported and unfolded.

It is a further object of the present invention to provide an array of panels that may be used as a presentation display.

It is a further object of the present invention to provide a collapsible array of panels that has numerous practical applications.

It is a further object of the present invention to provide a collapsible array of panels that may be unfolded and locked in a specific orientation with respect to each other.

It is a further object of the present invention to provide a method of manufacturing a collapsible array of panels in which the array is formed from a single sheet of a multilayer material.

It is a further object of the present invention to provide a method of manufacturing a collapsible array of panels in which separate individual panels are hinged together so that the array may be collapsed into a single stack of panels.

Other objects, features and advantages of present invention will become apparent upon reading the following specification, when taken in conjunction with the drawings and the appended claims.

DETAILED DESCRIPTION OF THE PREFERRED EMBODIMENT

Figure 1:
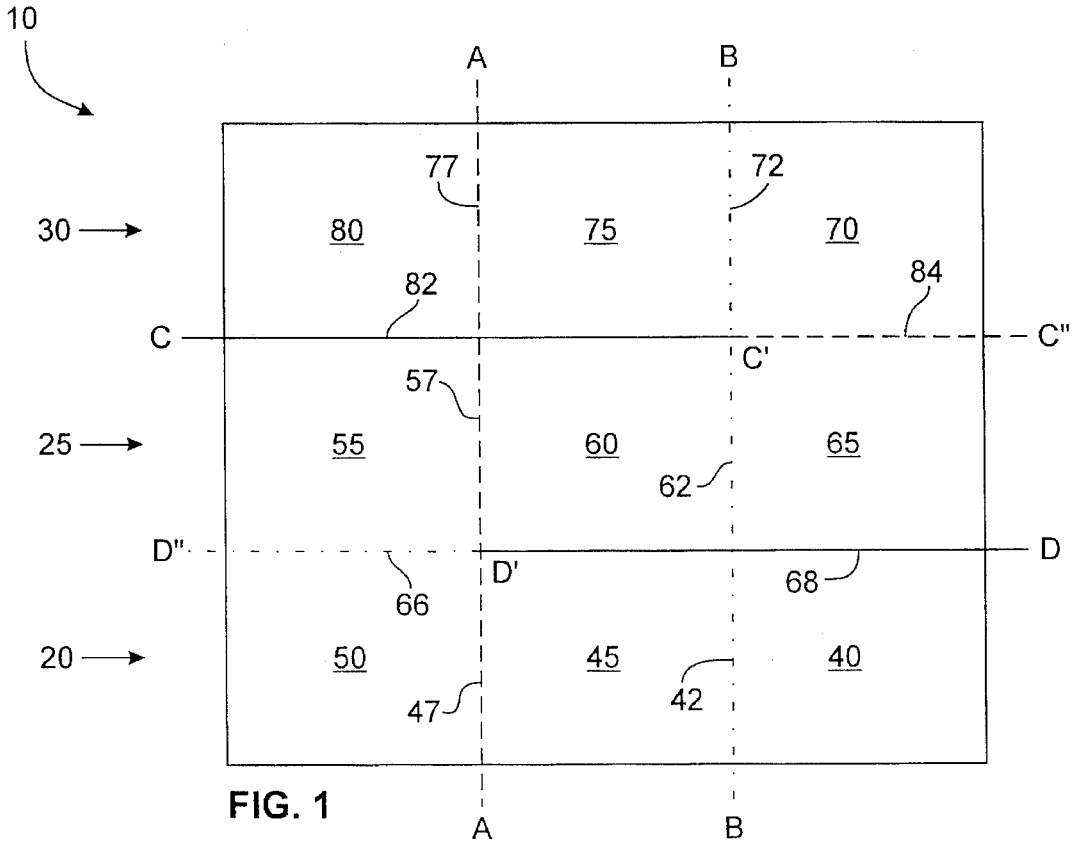
FIG. 1 shows a top view of a sheet of material that is cut and scored to form an array of panels in accordance with the preferred embodiment of the present invention.
Figure 2:
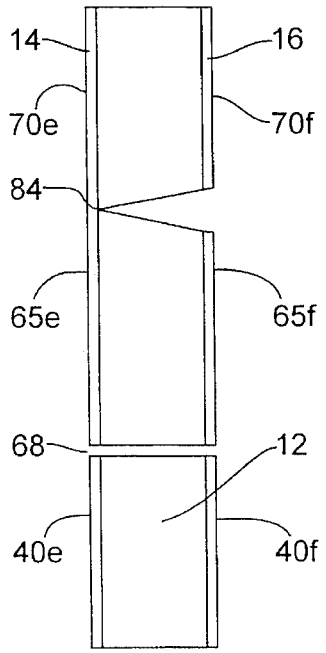
FIG. 2 shows a side view of the cut and scored sheet of material of FIG. 1.
Figure 3:
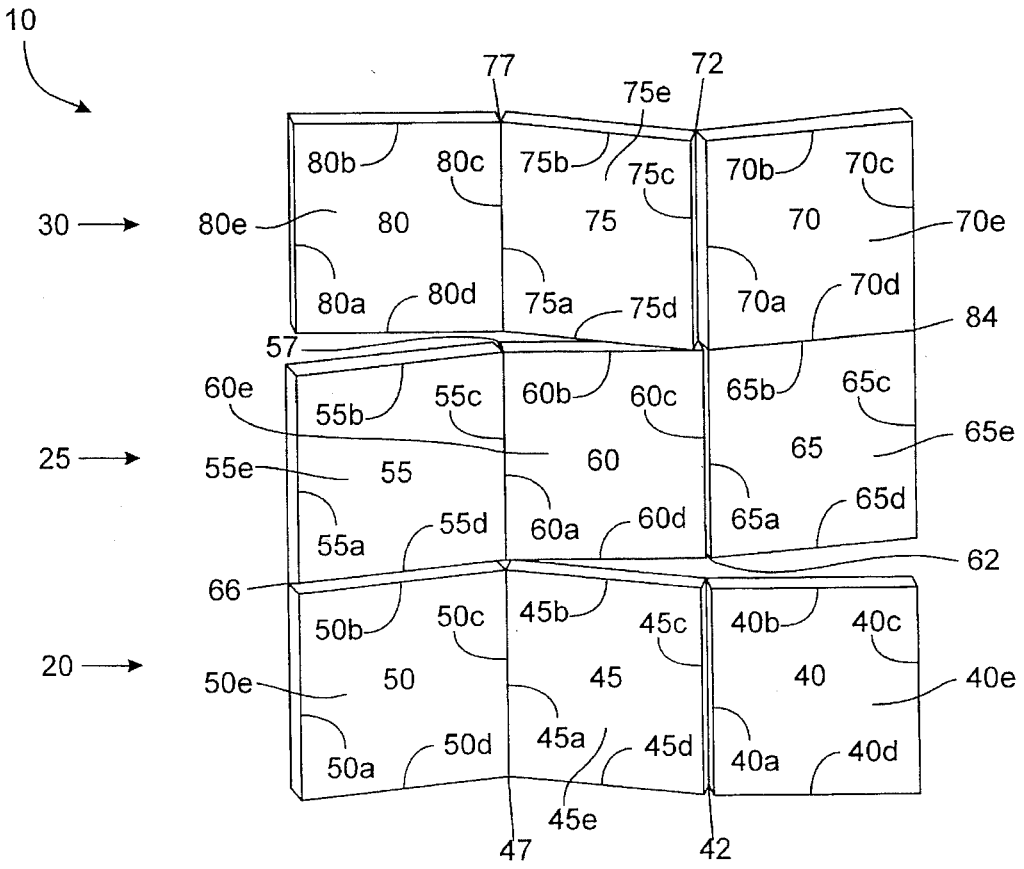
FIG. 3 shows a front elevational view of a collapsible array of panels formed from the sheet of material of FIG. 1.

Referring to the figures, in which like numerals represent like parts through the several views, FIGS. 1 and 3 show a collapsible 3×3 array of panels generally at 10 formed in accordance with the preferred embodiment of the present invention. The array of panels 10 is preferably formed from a lightweight three layer sheet of material. As shown in the side view in FIG. 2, on an enlarged scale, this three layer sheet of material is composed of a rigid Styrofoam core layer 12 and foldable top and bottom laminate layers 14 and 16 which are adhered to the core layer 12. The outer layers 14 and 16 may be made of paperboard or any other thin, foldable material well known to those skilled in the art. This type of three layer sheet of material is well known to those skilled in the graphics and display arts and is typically ⅛ to ½ of an inch in thickness. However, it should be appreciated that the array of the present invention may be formed from a single layer material, or from any similar type of three layer material that is capable of being cut and scored to form multiple rows of panels that are foldably connected to each other. The top and bottom layers 14 and 16 connect individual panels, formed from the core layer 12, in a manner that allows the array of panels to be folded into a single stack of panels, as will be described in greater detail below.

FIG. 1 illustrates a combination of cuts and scores that are made in the above-mentioned sheet of material to form the collapsible array of panels. The term cut is used throughout to refer to a severing of all layers of the sheet of material, while the term score is used throughout to refer to making a weakened fold line in the material. In the use of the preferred three layer sheet, a score refers to a line along which only the core layer 12 and either the top or the bottom layer 14 or 16 is severed, thus leaving adjacent panels foldably connected by either the top layer 14 or the bottom layer 16. Adjacent panels foldably connected by the top layer 14 may be collapsed in a direction out of the sheet of paper on which FIG. 1 is drawn and may be unfolded in a direction into the sheet of paper. Adjacent panels foldably connected by the bottom layer 16 may be collapsed in a direction into the sheet of paper and may be unfolded in a direction out of the sheet of paper.

A die cutting machine of the type well known to those skilled in the art is preferably used to make these cuts and scores. Knives and bars on the cutting machine may be set to make the necessary cuts and scores in the sheet of material. However, it should be appreciated that the array of panels 10 may also be formed using numerous other manufacturing tools and methods well known to those skilled in the art. At this point, it should also be appreciated that other types of scores or hinges may be used to foldably connect adjacent panels in the array of panels of the present invention. For example, scores may be formed or hinges, of the type well known to those skilled in the art, may be used to foldably connect adjacent panels to allow such panels to be collapsed and unfolded both into and out of the sheet of paper on which FIG. 1 is drawn.

Preferably, the above-mentioned die cutting machine scores the sheet of material along dash line AA, leaving the top layer 14 intact. The die cutting machine also scores the material along dot-dash line BB, leaving the bottom layer 16 intact. The die cutting machine also cuts the sheet of material along lines CC' and DD'. Further, the die cutting machine scores the sheet of material along lines C'C", leaving the top layer 14 intact. The die cutting machine also scores the sheet of material along line D'D", leaving the bottom layer 16 intact. Thus, the scores along the dash lines in FIG. 1 indicate that adjacent panels are connected by the top layer 14 and can be folded together along the dash lines in a direction out of the drawing, while the scores along the dotdash lines indicate that adjacent panels are connected by the bottom layer 16 and can be folded together in a direction into the sheet of paper on which FIG. 1 is drawn.

The resulting array of panels formed by the above cuts and scores has three rows of foldably connected panels, shown generally at 20, 25 and 30 in FIGS. 1 and 3. In the first row 20, a rightmost panel 40 is foldably connected by a hinge 42 (the bottom layer 16) to a middle panel 45, and the panel 45 in turn is foldably connected by a hinge 47 (the top layer 14) to a leftmost panel 50. In the second row 25, a leftmost panel 55 is foldably connected by a hinge 57 (the top layer 14) to a middle panel 60, and the panel 60 in turn is foldably connected by a hinge 62 (the bottom layer 16) to a rightmost panel 65. The leftmost panel 50 of the first row 20 is foldably connected to the leftmost panel 55 of the second row 25 by a hinge 66 (the bottom layer 16). In the third row 30, a rightmost panel 70 is foldably connected by a hinge 72 (the bottom layer 16) to a middle panel 75, and the panel 75 is foldably connected by a hinge 77 (the top layer 14) to a leftmost panel 80. The rightmost panel 65 of the second row 25 is foldably connected to the rightmost panel 70 of the third row 30 by a hinge 84 (the top layer 14). The panels in the array 10 in FIG. 1 are thus foldably connected in a manner that allows the panels in the 3×3 array to be collapsed into a 9×1 stack of panels. As previously described, the hinges 42, 47, 57, 62, 66, 72, 77 and 84 are preferably formed from either the top layer 14 or the bottom layer 16 of the sheet of material in the manner described above in conjunction with FIGS. 1 and 2. The hinges are exemplified by the side view of hinge 84 (formed from the top layer 14) in FIG. 2. However, it should be appreciated that the panels may be manufactured as separate panels and foldably connected by conventional hinges, rather than integral scores, in the above-described pattern according to the present invention.

FIG. 3 shows the array of foldably connected panels, resulting from the cuts and scores in the sheet of material shown in FIGS. 1 and 2, in a partially collapsed position to clearly illustrate the interconnection of the individual panels in each row, the interconnection of the rows 20 and 25 by the hinge 66, and the interconnection of the rows 25 and 30 by the hinge 84. As shown in FIG. 3, each of the panels 40, 45, 50, 55, 60, 65, 70, 75 and 80 is preferably of uniform thickness and has a left edge a, a top edge b, a right edge c, and a bottom edge d. Each panel also has a front face e and a rear face f, as shown in FIG. 2.

Figure 4A:
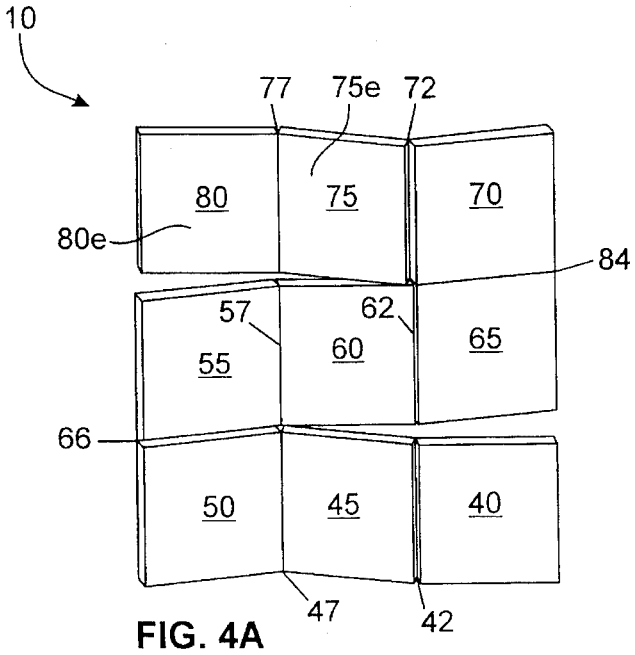
FIGS. 4A–4L are views illustrating the steps involved in collapsing the array of panels of FIG. 3 into a single stack of panels having a frontal dimension of one panel.
Figure 4B:
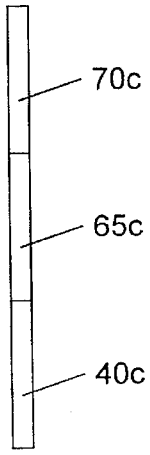
Figure 4C:
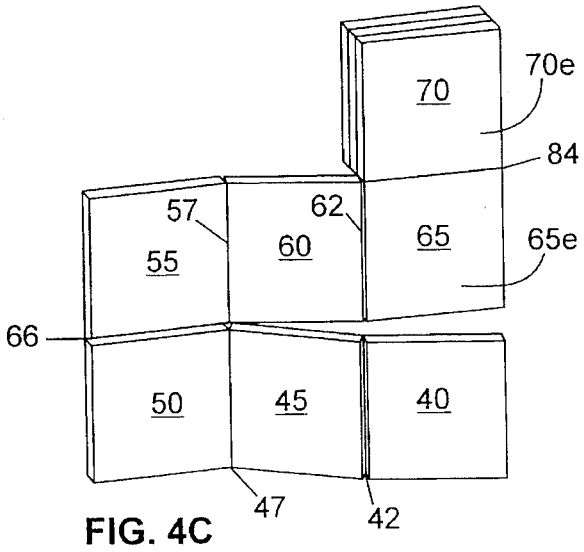
Figure 4D:
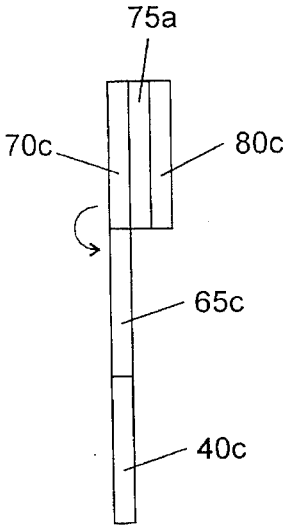

The method in which the array of panels shown in FIG. 3 is collapsed will now be discussed in conjunction with FIGS. 4A through 4L. FIGS. 4A, C, E, G, I and K show front elevational views of the array in various partially folded configurations, while FIGS. 4B, D, F, H, J and L show corresponding side views as seen from the direction indicated by arrow A. FIG. 4A shows the unfolded array of panels 10. FIG. 4B shows a side view of the array of FIG. 4A as seen from the direction of arrow A. To collapse the array, first the panel 80 is folded around the hinge 77 onto the panel 75 such that the front faces **75*e* and 80*e* of the panels lie adjacent to one another. The panels 75 and 80 are then folded around the hinge 72 onto the panel 70 such that the rear faces 70*f* and 75*f* of the panels lie adjacent to one another. The resulting partially collapsed array is shown in FIGS. 4C and 4D, with the panels 75 and 80 being hidden from view in FIG. 4C behind the panel 70**.

Figure 4E:
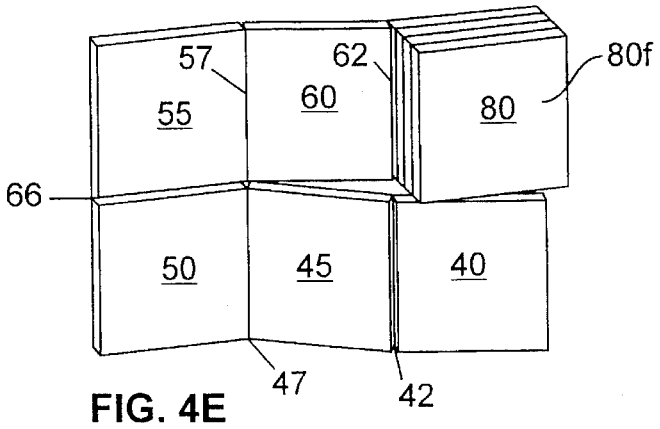
Figure 4F:
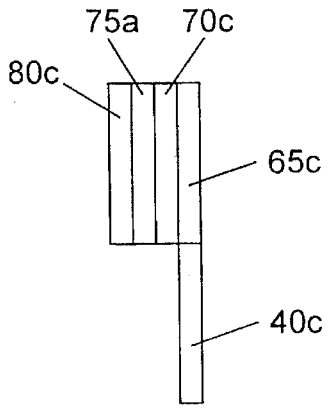

Next, the panels 70, 75 and 80 are folded around the hinge 84 down onto the panel 65 such that the front faces **65*e* and 70*e* of the panels lie adjacent to one another. As a result, the panels 70, 75 and 80 are stacked onto panel 65, as illustrated in FIGS. 4E and 4F, with panels 65, 70 and 75 being hidden from view behind panel 80** in FIG. 4E.

Figure 4G:
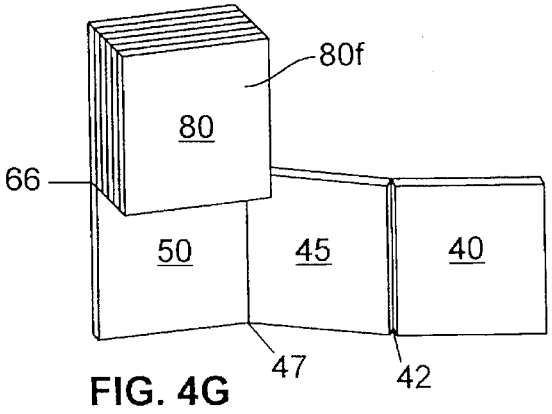
Figure 4H:
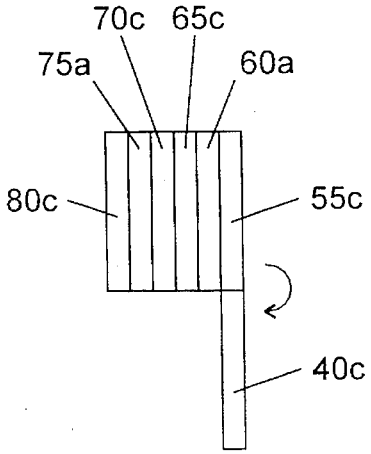
Figure 4I:
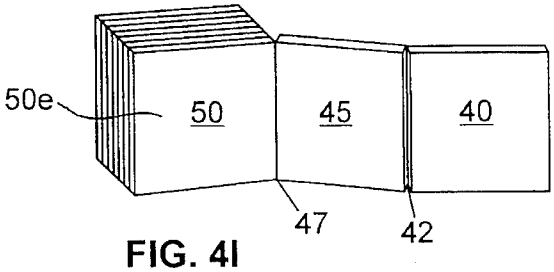
Figure 4J:
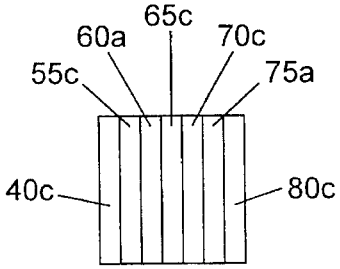

Next, the panels 65, 70, 75 and 80 are folded around the hinge 62 onto the panel 60 such that the rear faces 60*f* and 65*f* of the panels 60 and 65 lie adjacent to one another. Subsequently, the panels 60, 65, 70, 75 and 80 are folded around the hinge 57 onto the panel 55 such that the front faces 55*e* and 60*e* of the panels 55 and 60 lie adjacent to one another. Thus, panels 60, 65, 70, 75 and 80 are stacked onto panel 55, as shown in FIGS. 4G and 4H, with the panels 55, 60, 65, 70 and 75 being hidden from view behind panel 80 in FIG. 4G, while the panel 50 is hidden from view in FIG. 4H by the edge 40*c* of the panel 40.

Next, the panels 55, 60, 65, 70, 75 and 80 are folded around the hinge 66 down onto the panel 50 such that the rear faces 50*f* and 55*f* lie adjacent to one another. As a result, the panels 55, 60, 65, 70, 75 and 80 are stacked onto the back of the panel 50. These panels are hidden from view behind the panel 50 in FIG. 4I, while the panel 50 is hidden from view in FIG. 4J by the edge 40*c* of panel 40.

Figure 4K:
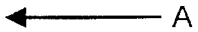
Figure 4K:
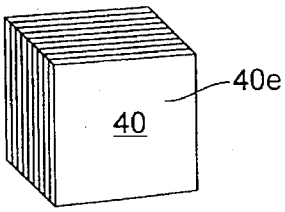
Figure 4L:
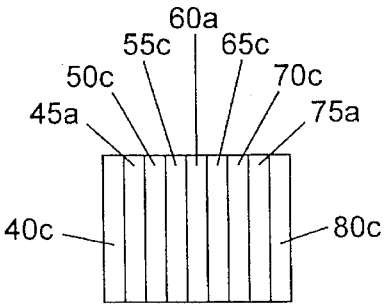

The panels 50, 55, 60, 65, 70, 75 and 80 are then folded around the hinge 47 and onto the panel 45 such that the front faces 45*e* and 50*e* lie adjacent to one another. Lastly, the panels 45, 50, 55, 60, 65, 70, 75 and 80 are then folded around the hinge 42 and onto the panel 40 such that the rear faces 40*f* and 45*f* lie adjacent to one another. The result is a single stack of nine foldably connected panels having a frontal dimension of one panel as shown in FIGS. 4K and 4L, with panels 45, 50, 55, 60, 65 70, 75 and 80 being hidden from view behind the panel 40 in FIG. 4K.

Figure 5:
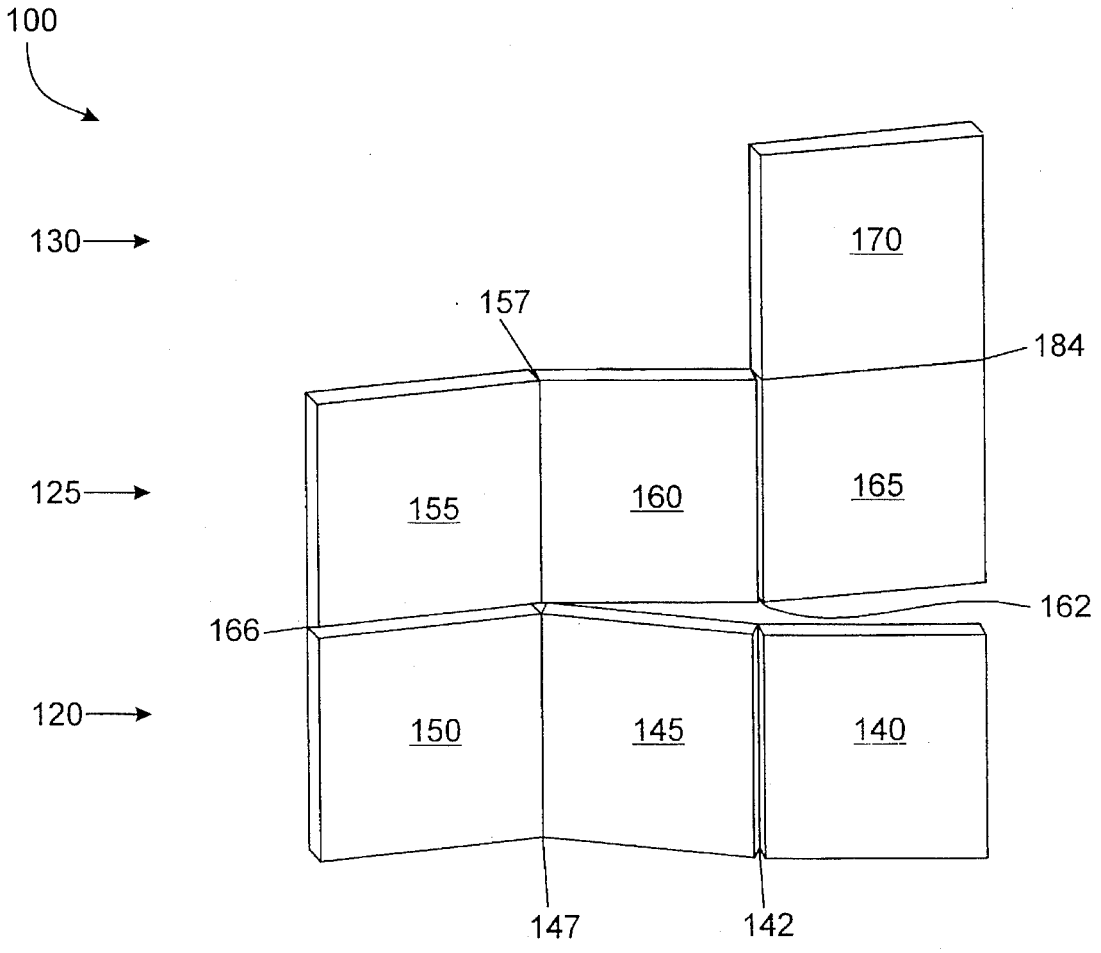
FIGS. 5, 6, 7A and 7B show front elevational views of alternate embodiments of the collapsible array of the present invention.

FIG. 5 shows an alternate embodiment of the array of panels of FIG. 3. The panels comprising the array 100 are foldably connected in the same manner as are the panels in the array 10. As with the array 10, the array 100 in FIG. 5 has three rows of panels 120, 125 and 130. However, the third row of panels 130 in FIG. 5 contains only one panel 170. Despite this difference, the array 100 is characterized by the same folding pattern as the array 10. The left panels 150 and 155 are foldably connected to the middle panels 145 and 160, respectively, by the hinges 147 and 157 formed by the top layer 14. The right panels 140 and 165 are foldably connected to the middle panels 145 and 160, respectively, by the hinges 142 and 162 formed by the bottom layer 16. The first row is foldably connected to the second row by the hinge 166 formed by the bottom layer 16, and the second row is foldably connected to the third row by the hinge 184 formed by the top layer 14. Although the array 100 has fewer panels than the array 10, the foldably connected panels may still be collapsed into a single stack of panels having a frontal dimension of one panel.

Figure 6:
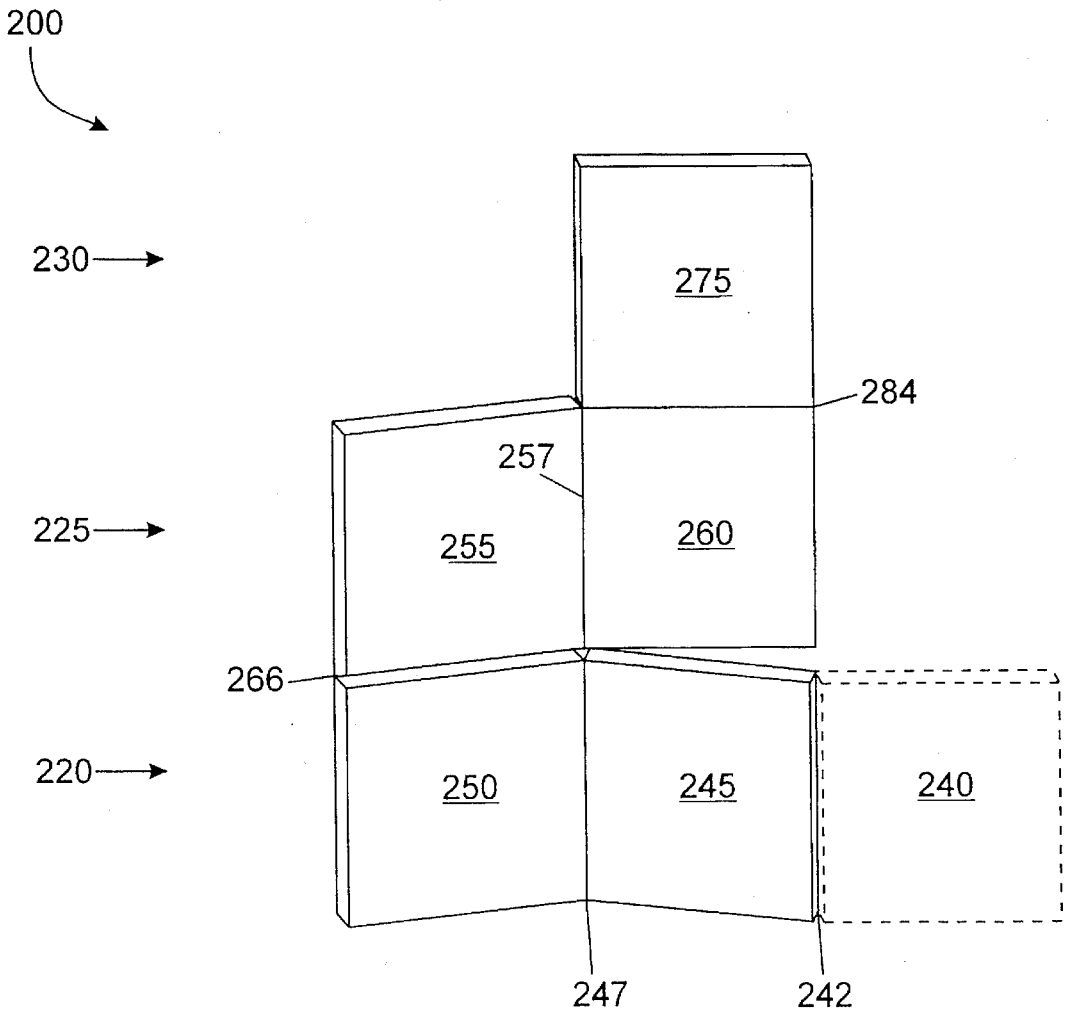

FIG. 6 illustrates yet another embodiment of collapsible array of the present invention, shown generally at 200. As with the array 10 in FIG. 3, the array of panels in this embodiment comprises three rows of foldably connected panels, shown generally at 220, 225 and 230. However, the rows 220 and 225 contain only two panels, while the row 230 contains only one panel. Because the rows each contain fewer than three panels, alternately folding panels onto the front and rear faces of adjacent panels as with the array in FIG. 3 is not possible. The left panels 250 and 255 are connected to the right panels 245 and 260, respectively, by the hinges 247 and 257 formed from the top layer 14. The first row is connected to the second row by the hinge 266, and the second row is connected to the third row by the hinge 284. Both the hinges 266 and 284 are formed by the bottom layer 16, as opposed the array 10, in which the hinge 66 is formed from the bottom layer 16 and the hinge 84 is formed from the top layer 14.

Thus, the array 200 may be collapsed in the following manner. The panel 275 is folded around the hinge 284 down onto the panel 260 such that the rear faces of the panels 260*f* and 275*f* lie adjacent to one another. Next, the panels 260 and 275 are folded around the hinge 257 onto the panel 255 so that the front faces 260*e* and 255*e* lie adjacent to one another. Next, the panels 255, 260 and 275 are folded around the hinge 266 and down onto the panel 250 such that the rear faces 250*f* and 255*f* of the panels lie adjacent to one another. Next, the panels 250, 255, 260 and 275 are folded around the hinge 247 such that the front faces 245*e* and 250*e* of the panels lie adjacent to one another. The resulting collapsed array of panels is a single stack of five panels having a frontal dimension of one panel.

Alternatively, an additional panel, as shown in phantom at 240, may also be connected to the panel 245 by the hinge 242 formed by the bottom layer 16. In this embodiment, the panel 240 may be folded around the hinge 242 such that the rear faces 240*f* and 245*f* of the panels lie adjacent to one another. If foldably connected in this manner, the additional panel 240 does not alter the ability of the array 200 to be collapsed into a single stack of panels.

Figure 7A:
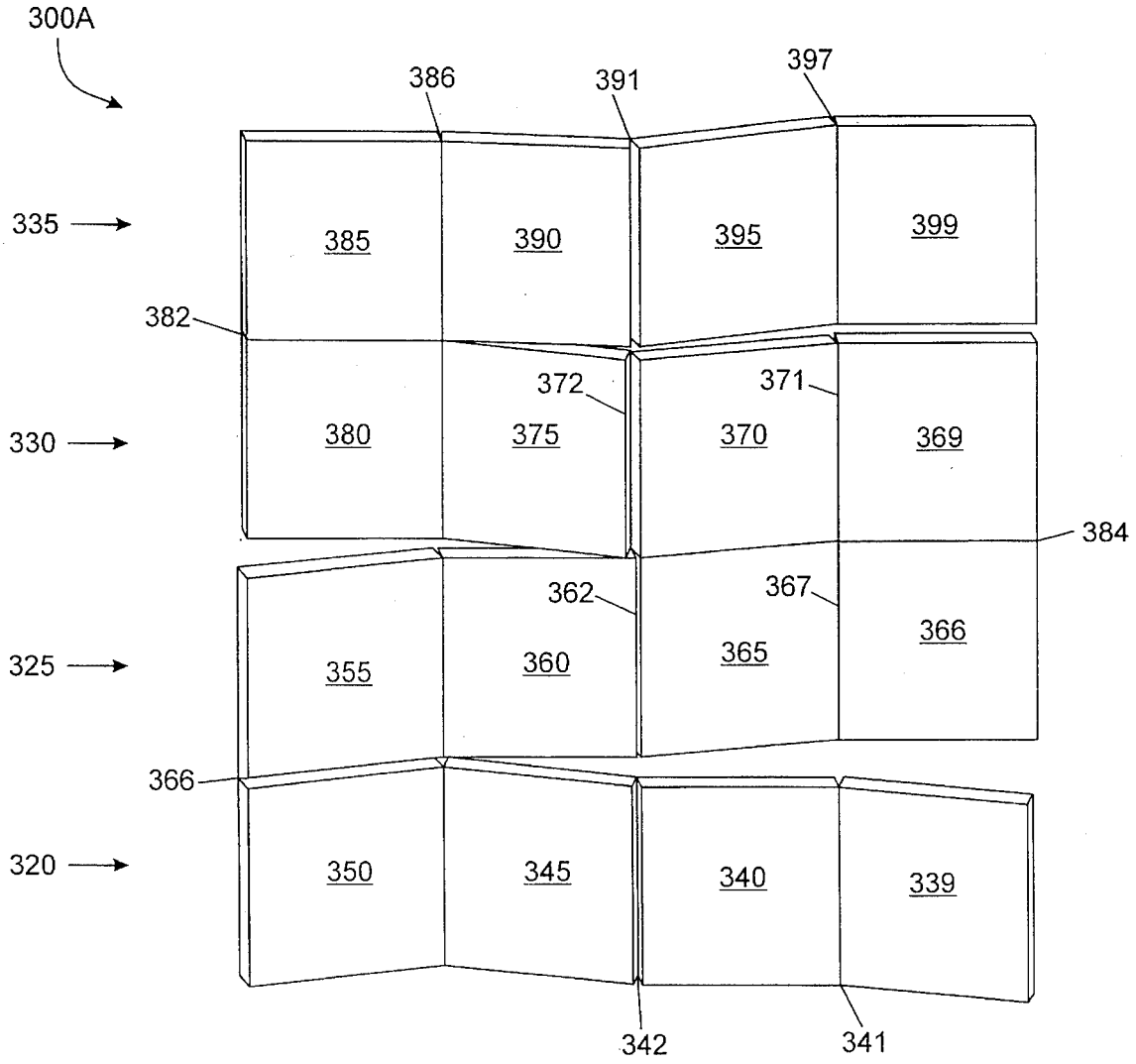

FIG. 7A shows yet another alternate embodiment of the present invention. This embodiment features a 4×4 array of foldably connected panels, as opposed to the 3×3 array of panels shown in FIG. 3. Rows 320, 325 and 330 have additional fourth rightmost panels 339, 366 and 369. The panels 339, 366 and 369 are connected to panels 340, 365 and 370, respectively by hinges 341, 367 and 371 formed by the top layer 14. An additional fourth row 335 of panels 385, 390, 395 and 399 is located above the third row 330. In the fourth row 335, the panel 385 is foldably connected to the panel 390 by a hinge 386 (the top layer 14), the panel 390 is foldably connected to the panel 395 by the hinge 391 (the bottom layer 16) and the panel 395 is foldably connected to the panel 399 by the hinge 397 (the top layer 14). The fourth row is foldably connected to the third row by a hinge 382 formed by the bottom layer 16 between the leftmost panels 385 and 380. This fourth row of panels 335, as with the fourth panels 339, 366 and 369, is an addition to the original array of nine panels of FIG. 3. However, it should be appreciated that the panels in the array 300A are connected in the same folding pattern as the array 10 in FIG. 3, such that the array of panels 300A may be collapsed into a single stack of panels having a frontal dimension of one panel.

Figure 7B:
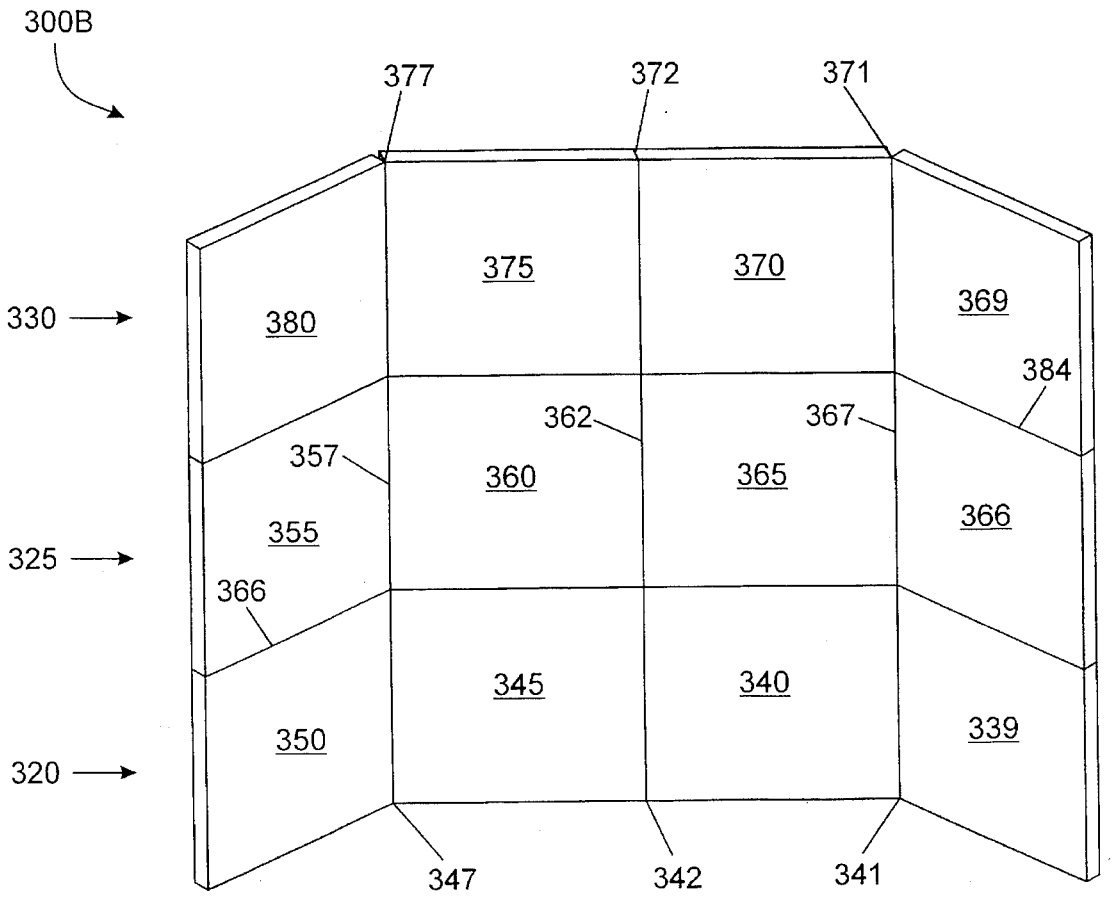

FIG. 7B shows an alternate embodiment similar to that shown in FIG. 7A, the difference being that the array of panels 300B is a 4×3 array as opposed to a 4×4 array. As in FIG. 7A, the rows 320, 325 and 330 have additional fourth rightmost panels 339, 366 and 369, and the panels 339, 366 and 369 are connected to panels 340, 365 and 370, respectively by hinges 341, 367 and 371 formed by the top layer 14. The fourth panels 339, 366 and 369 in each row are in addition to the original array of nine panels of FIG. 3. As shown in FIG. 7B, the middle two panels of each row (340 and 345 in row 320, 360 and 365 in row 325 and 370 and 375 in row 330) are folded around hinges 342, 362 and 372, formed by the bottom layer 16, in a direction out of the paper so that the middle six panels rest in a co-planar position. The leftmost outer panels 350, 355 and 380 and the rightmost outer panels 339, 366 and 369 are also folded in a direction out of the paper. However, because the leftmost and rightmost outer panels are folded around hinges formed by the top layer 14, the panels may be folded to a position that is more outward than the position of the middle six panels. An upright display with side wings results. The array, positioned as shown in FIG. 7B, thus is effectively self-supporting. It should be appreciated that the panels in the array 300B are connected in the same folding pattern as the array 10 in FIG.

3, such that the array of panels 300B may be collapsed into a single stack of panels having a frontal dimension of one panel.

It should be appreciated that additional panels may be added or deleted from the arrays of panels shown in FIGS. 3–6 and 7A–7B, if the additional or remaining panels in the array are foldably connected in a manner that allows a set of panels to be collapsed according to the invention into a single stack of panels.

Figure 8:
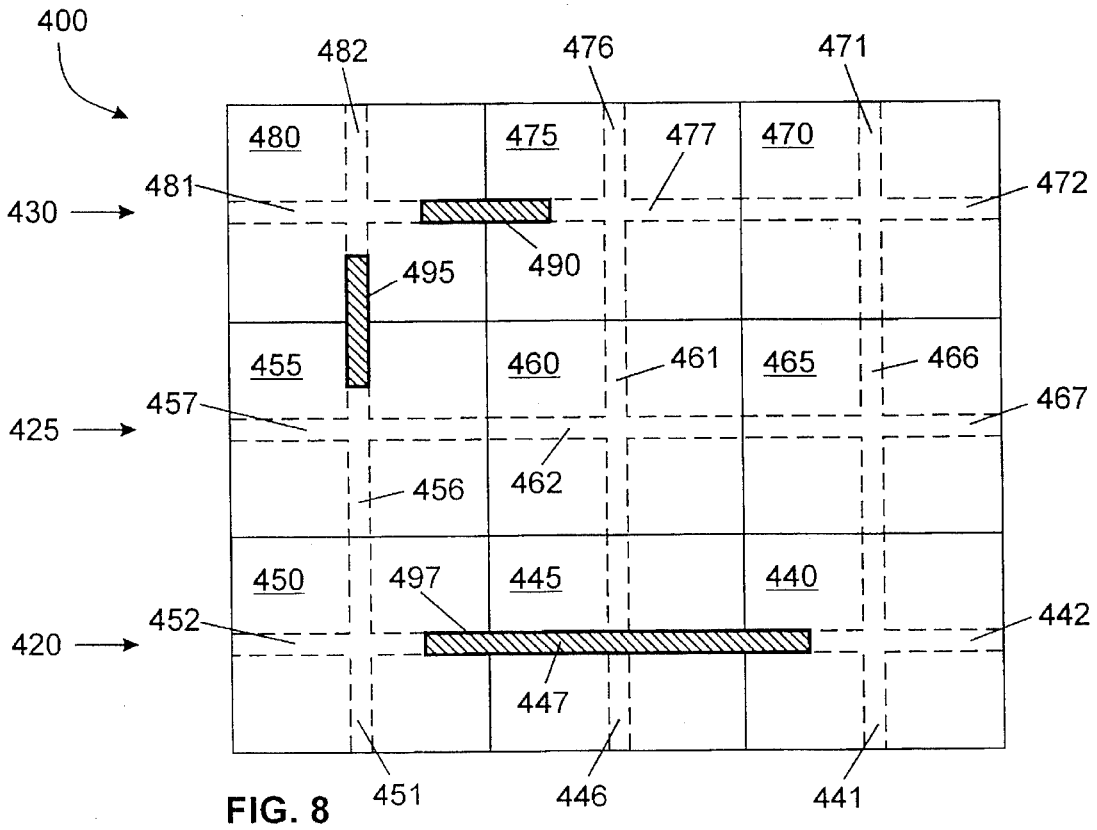
FIG. 8 is a front view of an alternate embodiment of the collapsible array of panels of FIG. 3, showing, in phantom, connecting pin channels into which connecting pins are inserted.

FIGS. 8–12 show two preferred methods of holding the array of panels shown in FIG. 3 in various configurations. FIG. 8 shows a 3×3 array of panels 400 foldably connected in a manner identical to that of the array of panels 10 shown in FIG. 3, with the individual panels each containing internal connecting pin channels 441–482. These connecting pin channels are formed in the core layer 12 of the sheet of material in a manner that allows the panels to be interconnected by connecting pins as will be described in detail below. Also, these channels are of a diameter small enough so as to not weaken the actual structure of the individual panels. Generally, these connecting pin channels are formed by boring through the core layer of each panel from one edge to another in a manner that allows the connecting pin channels of adjacent panels to be co-axially aligned when the adjacent panels are unfolded. While the array 400 in FIG. 8 shows each panel having one longitudinal and one transverse connecting pin channel, it should be appreciated that each panel may have any number of these connecting pin channels.

In a row of panels 420 in FIG. 8, panels 440, 445 and 450 have longitudinal connecting pin channels 441, 446 and 451 and transverse connecting pin channels 442, 447 and 452, respectively. Similarly, in an adjacent row 425, panels 455, 460 and 465 have longitudinal connecting pin channels 456, 461 and 466 and transverse connecting pin channels 457, 462 and 467. Also, in a third row 430, panels 470, 475 and 480 have longitudinal connecting pin channels 471, 476 and 482 and transverse connecting pin channels 472, 477 and 481.

Figure 9:
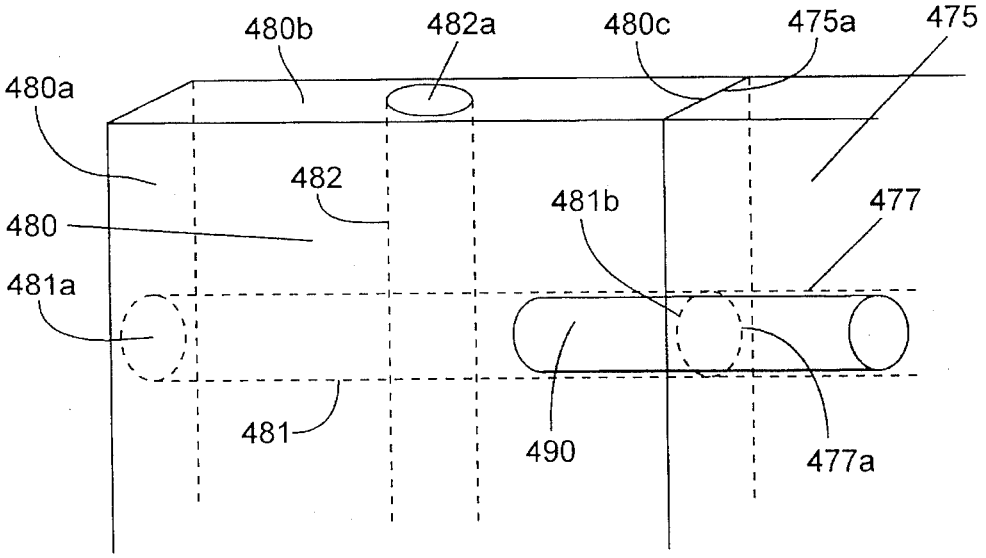
FIG. 9 is a magnified front elevational view of the top left corner of the collapsible array of panels of FIG. 8.

Each of the connecting pin channels is exemplified by the longitudinal connecting pin channel 482 and the transverse connecting pin 481 shown in a magnified view of the upper left corner of the array 400 depicted in FIG. 9. The longitudinal channel 482 is characterized by a first opening 482*a* in an edge 480*b* of the panel 480 and extends through the core layer of the panel 480 to an opening at the opposite edge of the panel. Such opening (not shown) is co-axially aligned with an opening (not shown) in the upper edge of the panel 455 leading to the channel 456, when the panels are unfolded as in FIG. 8. Similarly, the transverse connecting pin channel 481 is characterized by an opening 481*a* in a side edge 480*a* of the panel 480 and extends through the core layer of the panel 480 to an opposite edge 480*c*, which defines a second opening 481*b* (shown in phantom). The opening 481*b* is co-axially aligned with an opening 477*a* in an edge 475*a* of the panel 475 leading to the channel 477, when the panels are unfolded as in FIG. 8. Thus, as illustrated in both FIGS. 8 and 9, when adjacent panels such as panels 475 and 480 are unfolded, a connecting pin 490 may be inserted through the connecting pin opening 481*a* into the connecting pin channel 481 and positioned in a friction fit in both the channels 477 and 481 spanning the panel edges, to hold the adjacent panels 475 and 480 in an unfolded position. Similarly, a connecting pin 495 may be inserted through the connecting pin opening 482*a* into the connecting pin channel 482 and positioned in a friction fit in both the channels 456 and 482, and spanning the panel edges, to hold the adjacent panels 455 and 480 in an unfolded position. The connecting pins may be configured so as to hold two adjacent panels in a specific orientation with respect to each other, as illustrated by the pins 490 and 495, or a longer connecting pin may be configured to hold a number of panels simultaneously in a specific orientation with respect to each other, as illustrated by pin 497 in FIG. 8, which spans panels 440, 445 and 450. The pins may be inserted into edge openings manually, and then pushed into position using a thin rod. The rod may be marked with indicia to indicate how far the pin should be inserted to span the edges of adjacent panels.

Figure 10A:
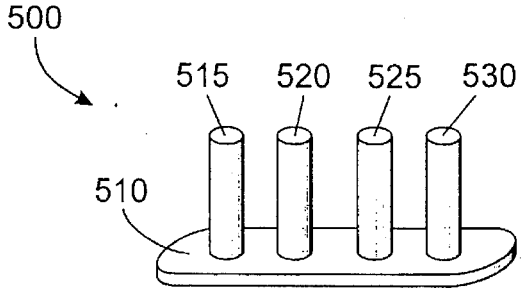
FIG. 10A is a front elevational view of a retainer used with an alternate embodiment of the collapsible array of panels of the present invention.

FIG. 10A shows a retainer 500 that may be used to hold adjacent panels in an array of panels in a specific orientation with respect to each other. Such retainers may be used in place of or in conjunction with connecting pins as described above. The retainer 500 is formed from plastic, metal or wood and is used to immobilize a hinge between two adjacent panels and thus provide stability to an array of panels. The retainer has a rigid back plate 510 with prongs 515, 520, 525 and 530 extending therefrom. The specific orientation in which the adjacent panels are held with respect to each other may range anywhere from 0° to 180°, depending on the placement of the prongs on the back plate 510 and the angle at which the back plate is shaped.

Figure 10B:
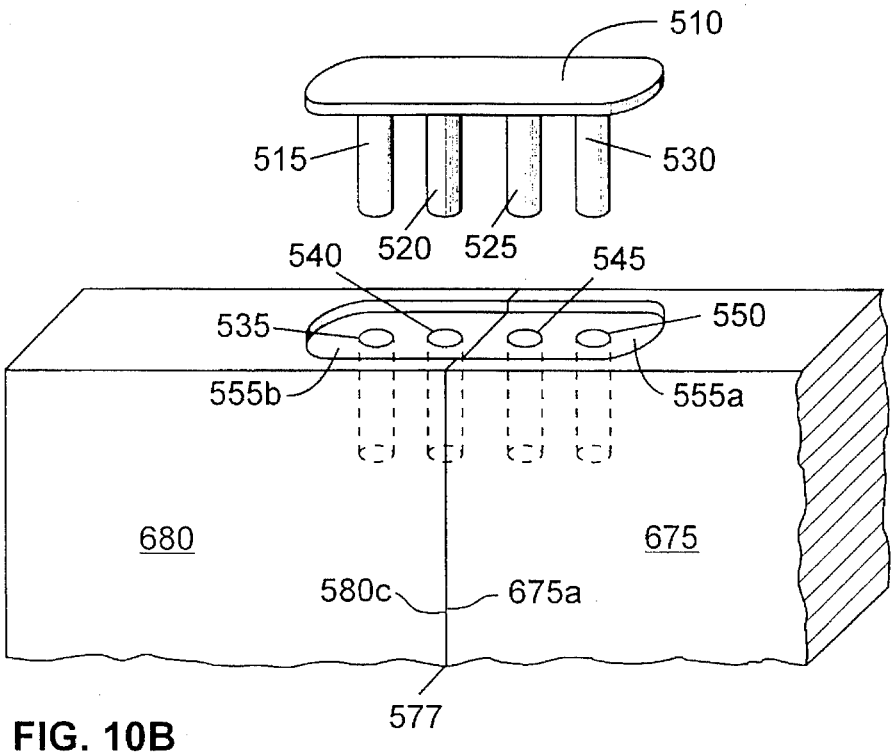
FIG. 10B is a magnified front elevational view of the top left corner of a collapsible array of panels illustrating the insertion of the retainer of FIG. 10A into adjacent panels in the collapsible array of panels.

As shown in FIG. 10B, prong receptacles 535, 540, 545 and 550 are formed in the outer edges of panels 675 and 680, which are exemplary of all of the panels in an array 600. The array 600 is identical to the array 10 of FIG. 3, having the added feature of prong receptacles in the edges of its panels (the array 600 is shown collapsed into a 9×1 stack of panels in FIG. 12). These prong receptacles extend into the core layer of the panels in the array and are configured to accept the prongs 515, 520, 525 and 530 of the retainer 500 in a frictional fit. The prong receptacles 545 and 550 are formed in the panel 675 to the right of the hinge 577, while the prong receptacles 535 and 540 are formed in the panel 680 to left of the hinge 577. When the panel 680 is unfolded and the panel edges 675*a* and 680*c* lie adjacent one another, the prong receptacles 535, 540, 545 and 550 are aligned in a manner that positions the receptacles to accept the prongs 515, 520, 525 and 530, as shown in FIG. 10C.

Additionally, a shallow indentation 555 is formed in the outer edges of adjacent panels 675 and 680 in conjunction with the prong receptacles 535, 540, 545 and 550 to receive the back plate 510 of the retainer when the prongs 515, 520, 525 and 530 are placed into the prong receptacles. The indentation 555 consists of an indentation 555*a* to the right of the hinge 577 in panel 675 and an indentation 555*b* to the left of the hinge 577 in panel 680. As the panel 680 is unfolded around hinge 577 so that panel edges 675*a* and 680*c* are positioned adjacent one another, as illustrated in FIG. 10B, the separate indentations 555*a* and 555*b* together form the indentation 555.

Figure 10C:
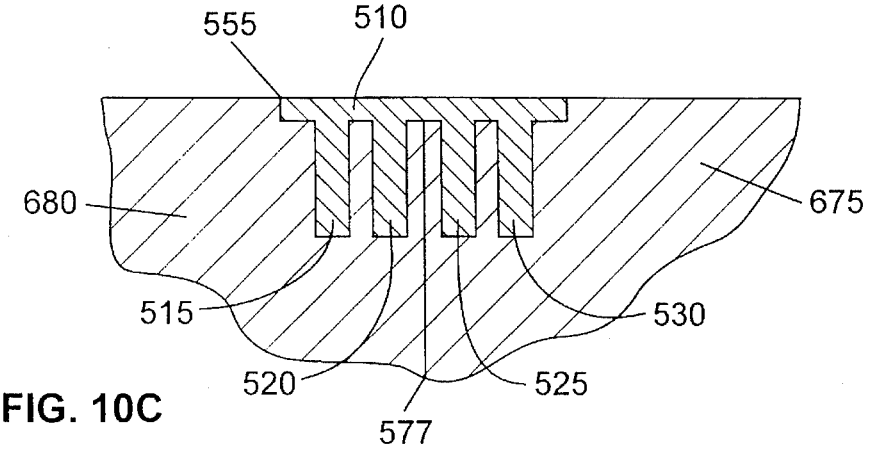
FIG. 10C is a side cross sectional view of the array of panels of FIG. 10B, showing the retainer inserted into adjacent panels.

FIG. 10C shows the retainer 500 after the prongs 515, 520, 525 and 530 have been inserted into the prong receptacles 535, 540, 545 and 550. The prongs engage the prong receptacles in a friction fit and effectively lock the hinge 577. Also, the back plate 510 rests in the indentation 555 such that the back plate 510 lies substantially flush with the top edges 675*b* and 680*b* of the panels 675 and 680. The aesthetic qualities of the array are thus maintained, as the retainers used around the periphery of the array remain hidden from view.

Figure 11A:
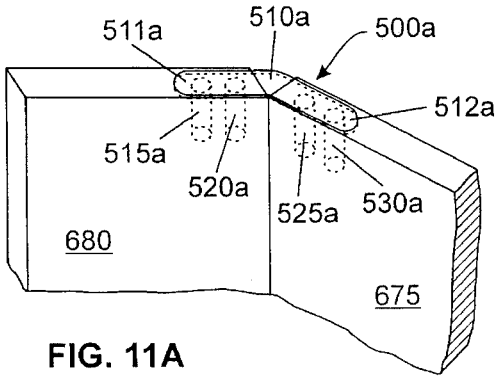
FIGS. 11A–11C are front elevational views showing alternate embodiments of the retainer of FIG. 11 inserted into two adjacent panels in a collapsible array of panels.
Figure 11B:
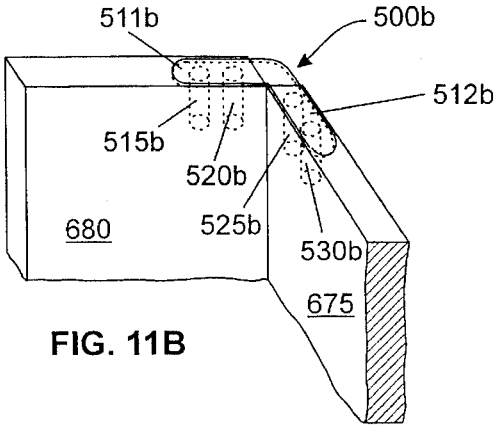
Figure 11C:
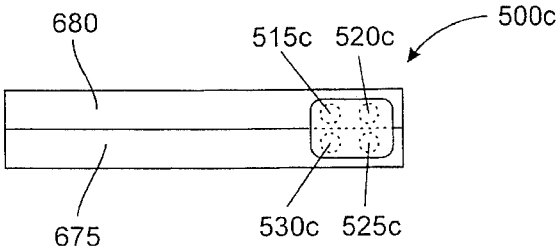

FIGS. 11A–11C show alternate embodiments of the retainer 500 configured to retain the adjacent panels 675 and 680 in various orientations with respect to each other. FIG. 11A shows an alternate embodiment of the retainer 500 generally at 500*a*. The back plate 510*a* of the retainer 500*a* is shaped so that the sides 511*a* and 512*a* of the back plate 510 form an angle of approximately 150° with respect to each other. The prongs 515*a* and 520*a* are positioned on the side 511*a* and spaced apart at a distance equal to the distance between a pair of prong receptacles, while the prongs 525*a* and 530*a* are positioned on the side 512*a* and spaced apart at a distance equal to the distance between a pair of prong receptacles. When the panels 675 and 680 are positioned with respect to each other at approximately the same angle as that formed by the sides 511*a* and 512*a*, the retainer prongs may be inserted into the corresponding prong receptacles to immobilize the hinge 577. When the prongs are inserted in such a manner, the retainer 500*a* immobilizes the hinge 577 and maintains the panels 675 and 680 at an angle of approximately 150° with respect to each other.

FIG. 11B shows yet another embodiment of the retainer 500 generally at 500*b*. The back plate 510*b* of the retainer 500*b* is L-shaped so that the sides 511*b* and 512*b* form an angle of approximately 90° with respect to each other. The prongs 515*b* and 520*b* are positioned on the side 511*b* and spaced apart at a distance equal to the distance between a pair of prong receptacles, while the prongs 525*b* and 530*b* are positioned on the side 512*b* and spaced apart at a distance equal to the distance between a pair of prong receptacles. When the panels 675 and 680 are positioned with respect to each other at approximately the same angle as that formed by the sides 511*b* and 512*b*, the retainer prongs may be inserted into the corresponding prong receptacles. When the prongs are inserted in such a manner, the retainer 500*b* immobilizes the hinge 577 and maintains the panels 675 and 680 at an angle of approximately 90° with respect to each other.

FIG. 11C shows yet another embodiment of the retainer 500 generally at 500*c*. The back plate 510*c* is rectangular in shape, with a width being approximately that of two panels and a length sufficient to accommodate a pair of prong receptacles of a panel. The pairs of prongs 515*c*, 520*c*, 525*c* and 530*c* are mounted on the back plate 510*c* adjacent to one another in a square grid pattern, so that the grid can span two panels 675 and 680 lying adjacent to one another. When the panels are in a folded position so that the front faces 675*e* and 680*e* of the two panels lie adjacent to each other, the retainer prongs are inserted into the prong receptacles. With the retainer prongs inserted, the retainer 500*c* effectively locks the panels 675 and 680 into a folded position.

At this point, it should be appreciated that the retainers described above may be formed to hold adjacent panels in any number of positions relative to each other, and that retainers may be formed to effectively lock more than one panel hinge at a time. It should also be appreciated that the retainers may be spring-loaded or may possess some other type of biasing mechanism to create the frictional fit between the retainer prongs and the prong receptacles.

Figure 12:
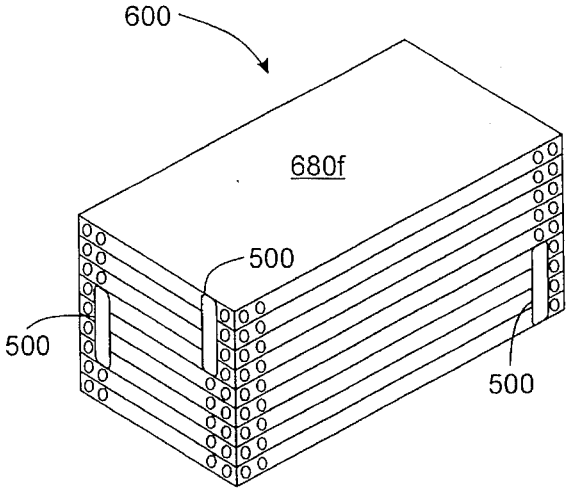
FIG. 12 shows retainers stored in conjunction with a collapsed array of panels of the present invention.

The prong receptacles are formed to accept retainers, in the manner shown in FIG. 10B, when adjacent panels are unfolded and the prong receptacles of adjacent panels are aligned as described above. The prong receptacles are also formed so that the retainers may be inserted into the prong receptacles for storage purposes when the panels are foldably collapsed, as shown in FIG. 12. When the panels are foldably collapsed, the prong receptacles are aligned in vertical columns, with the prong receptacles of each panel edge being spaced apart at a distance corresponding to the distance between the prongs of the retainer. FIG. 12 illustrates several of the retainers 500 inserted into the prong receptacles formed in the edges of panels in the array 600. Thus, it is not necessary to have additional storage containers and storage space for the retainers. Portability of the entire assembly is maintained, and the stacked panels are additionally kept from unfolding during storage and transportation as a result of the friction fit of the retainers in the prong receptacles. As will be understood, the back plates do not nest within the indentations along the panel edges in the configuration shown in FIG. 12.

FIGS. 13–16 show the array of panels 10 arranged in various unfolded and partially unfolded configurations for stability and/or aesthetic purposes. These figures show that the array of panels may be arranged in certain configurations without the need for the connecting pins or the retainers described above.

Figure 13:
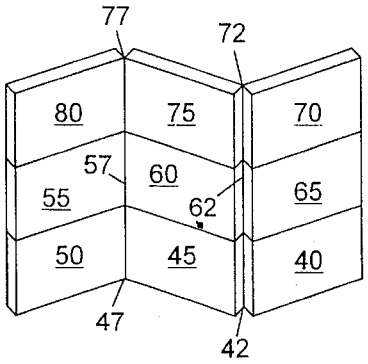
FIGS. 13, 14 and 15A–15B show alternate arrangements of the array of panels of FIG. 3.

FIG. 13 shows the array in a semi-unfolded configuration, which allows the array to be self supporting. The array is unfolded as in FIG. 3, but in a more exaggerated Z-shaped configuration. This configuration is achieved by folding the panels 40, 65 and 70 around hinges 42, 62 and 72 in a direction into the sheet of paper on which FIG. 13 is drawn. Also, the panels 50, 55 and 80 are folded around hinges 47, 57 and 77, respectively, in a direction out of the sheet of paper on which FIG. 13 is drawn.

Figure 14:
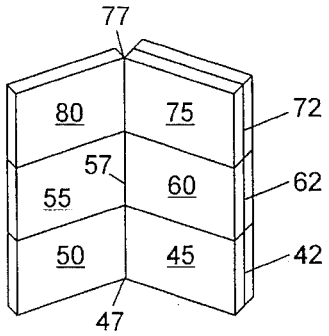

FIG. 14 shows the array of panels 10 in another partially unfolded position as in FIG. 3, with panels 40, 65 and 70 additionally folded around hinges 42, 62 and 72 in a direction into the sheet of paper on which FIG. 14 is drawn and behind panels 45, 60 and 75. The resulting partially folded array of panels forms a 2×3 array instead of the 3×3 array in FIG. 3.

Figure 15A:
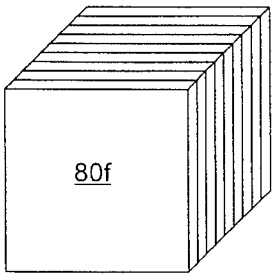
Figure 15B:
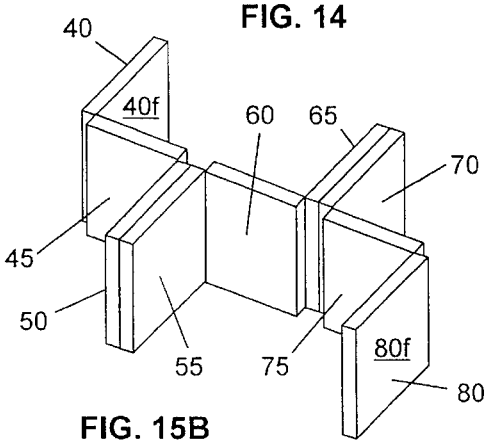

FIG. 15B shows the array of panels 10 in a self supporting arrangement in which the array has a height of only one panel. This configuration is formed as follows. First, as shown in FIG. 15A, the stack of panels 10 is placed so that the rear face 80*f* of the panel 80 defines the front of the collapsed array of panels. Next, the panel 60 is folded in a direction out of the sheet of paper on which FIG. 15A is drawn so that the panels 60, 65, 70, 75 and 80 form a 90° angle with respect to panels 40, 45, 50 and 55. Next, panel 65 is unfolded around hinge 62 in a direction out of the sheet of paper so that panels 65, 70, 75 and 80 form a 90° angle with panel 60. Next, panel 75 is unfolded from panel 70 around hinge 72 in a direction out of the sheet of paper so that panels 75 and 80 form a 90° angle with respect to panels 65 and 70. Next, panel 80 is unfolded from panel 75 around hinge 77 in a direction out of the sheet of paper so that panel 80 forms a 90° angle with panel 75.

Next, the panel 55 is unfolded from the panel 60 in a direction into the sheet of paper on which FIG. 15A is drawn so that panels 40, 45, 50 and 55 form a 90° angle with respect to the panel 60. Next, the panels 40 and 45 are unfolded from panel 50 around hinge 47 in a direction into the sheet of paper so that panels 40 and 45 form a 90° angle with respect to the panels 50 and 55. Finally, the panel 40 is unfolded from panel 45 around hinge 42 in a direction into the sheet of paper so that the panel 40 forms a 90° angle with the panel 45. In this arrangement, the panels 40 and 80 serve as outer supports, while panels 50, 55, 65 and 70 serve as interior supports for the array of panels. The resulting single level array of panels is shown in FIG. 15B.

It should be appreciated that either connecting pins or retainers, or both, may be used to provide stability to any of the aforementioned arrays of panels shown in FIGS. 13, 14 and 15B if the arrays are properly configured to received connecting pins or retainers. However, the configurations in FIGS. 13, 14 and 15B are substantially self supporting even without connecting pins and/or retainers.

Figure 16A:
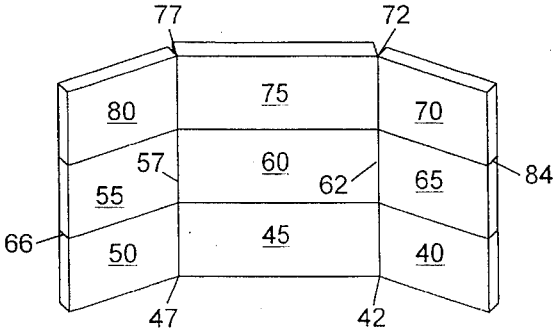
FIGS. 16A–16B show an alternate embodiment of a 3×3 array of panels in which the middle panels of each row are greater in width than the left panels and right panels of each row.
Figure 16B:
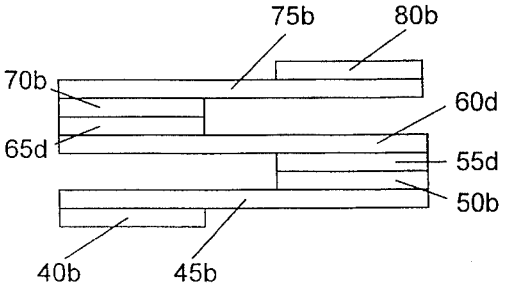

FIG. 16A shows a 3×3 array of panels in a configuration that is possible when the panel hinges are formed to allow the panels to be folded in a direction both into and out of the sheet of paper on which FIG. 16A is drawn. In FIG. 16A, the width of the middle panel in each row is greater in width than the outer panels in each row. In FIG. 16A, panels 50, 55 and 80 are folded around hinges 47, 57 and 77 in a direction out of the sheet of paper. Similarly, panels 40, 65 and 70 are folded around hinges 42, 62 and 72 in a direction out of the sheet of paper, as opposed to the panels 40, 65 and 70 in FIG. 13, which are connected by the bottom layer 16 and thus can be folded only in a direction into the sheet of paper. An upright display with side wings results. As with the array of FIG. 7B, the array of panels in FIG. 16A, when arranged in this configuration, is substantially self-supporting. The array, even with the width of the middle panels 45, 60 and 75 being greater in width than the outer panels, may still be collapsed into a single stack of panels in a manner identical to that described in conjunction with FIGS. 4A–4L and as shown in FIG. 16B.

Figure 17:
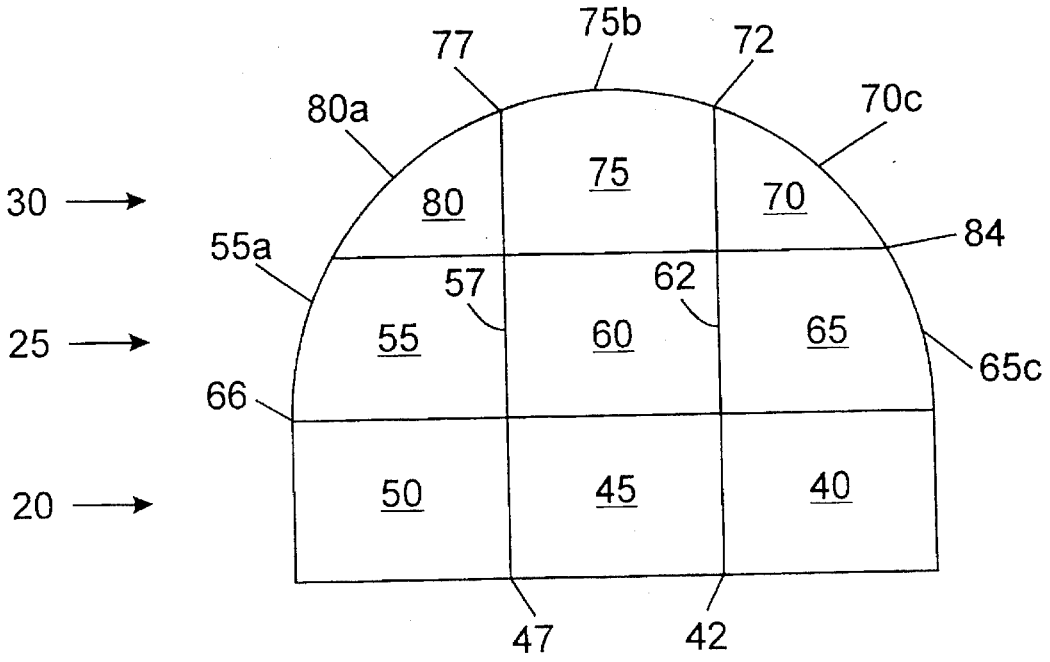
FIG. 17 shows an alternate embodiment of a 3×3 array of panels in which the panels are of differing shapes and sizes.
Figure 18:
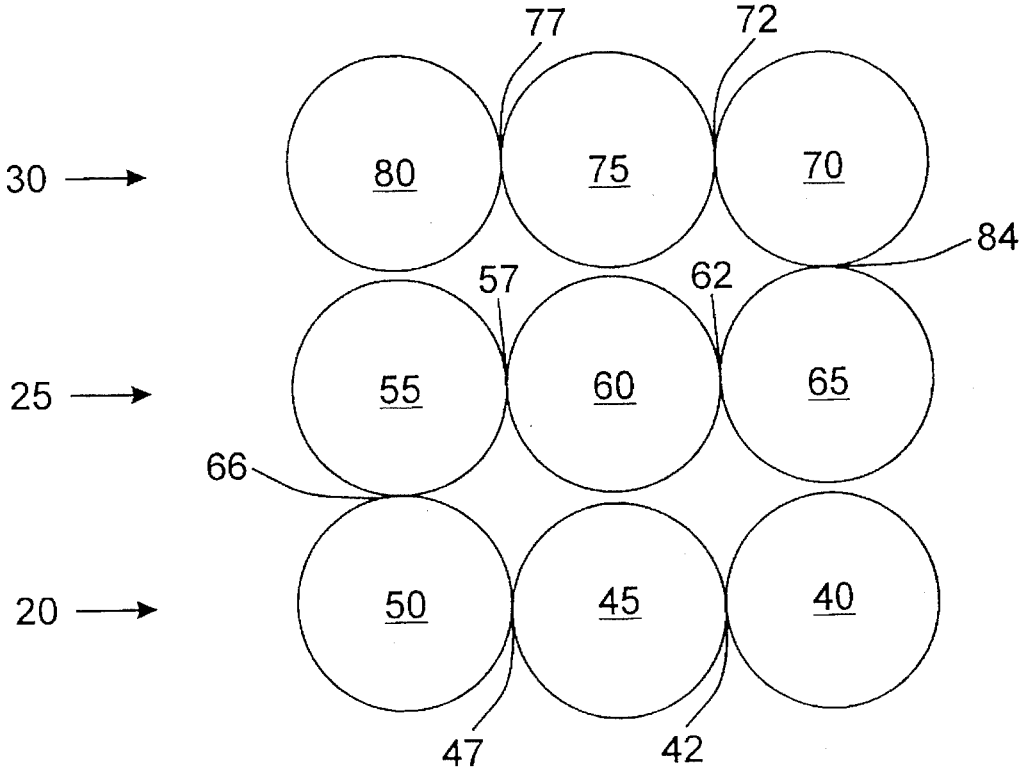
FIG. 18 shows an alternate embodiment of a 3×3 array of panels in which the panels are circular instead of rectangular.

FIGS. 17 and 18 show alternate embodiments of 3×3 arrays of panels hinged together in a manner consistent with the configuration shown in FIG. 3. FIG. 17 shows an array in which the individual panels are of non-uniform heights and widths, but in which the individual panels are hinged together in the same manner as that described in conjunction with FIG. 3. In FIG. 17, the outer left edges 55*a* and 80*a* of the panels 55 and 80 in rows 25 and 30 are rounded. Similarly, the outer right edges 65*c* and 70*c* of the panels 65 and 70 in rows 25 and 30 are rounded. The top edge 75*b* of the middle panel 75 in row 30 is also rounded. Thus, the array of panels, when completely unfolded as shown, forms a half-circle which can be used for display purposes or for other purposes as set forth below. While this semi-circular array differs aesthetically from the array shown in FIG. 3, it should be appreciated that the array in FIG. 17 may still be collapsed into a single stack of panels for ease of storage and transportation.

FIG. 18 shows a 3×3 array of circular panels hinged together in the same manner as that described in conjunction with FIG. 3. When the array is completely unfolded, interior openings are formed in the middle of each group of four panels. Similarly, indentations are formed around the outer periphery of the array between each pair of adjacent panels. Thus, the unfolded array forms a non-continuous surface that differs aesthetically from the array in FIG. 3. However, it should be appreciated that the array in FIG. 18 may still be collapsed into a single stack of panels having a frontal dimension of one circular panel for ease of storage and transportation.

In view of FIGS. 17 and 18, it should be appreciated that individual panels of numerous other shapes and sizes may be utilized in the collapsible array of the present invention. Individual panels in such an array may be of non-uniform height, width and/or thickness and may be of any shape or size, as long as the panels are hinged in a manner consistent with that described in detail above and as long as the array may be foldably collapsed into a single stack of panels.

It should also be appreciated that the number of panels in each row of any of the aforementioned arrays of panels, and/or the number of rows in any of the aforementioned arrays of panels, may be more or fewer than those in the embodiments described above, as long as the ability of the array to be collapsed into a single stack of panels is maintained.

It should be appreciated that any of the aforementioned arrays of panels may be utilized as a subassembly of a device or a larger array. That is, the present invention may be embodied in an array which has the capability of being collapsed as a sub-assembly onto a portion of the larger device or array.

The several embodiments of the collapsible array of panels of the present invention may be used for presentation displays for business meetings, trade shows, for educational purposes and the like. However, it should be appreciated that such a collapsible array of panels as disclosed herein may also be used for a myriad of other purposes, including, but not limited to, dry-erase whiteboards, pegboard displays, floor or ceiling tiling, wall paneling, floor mats, window inserts, insulation panels, transportable and collapsible billboards, windshield inserts for cars, transportable emergency road signs, temporary partitions, or collapsible supports/legs of a table, workbench, stand or planar work area. The size of the array of panels may be scaled according to the particular application.

It should be appreciated that relative terms such as "row", "upper", "lower", "above", "below", "right", "left", "first", "second" and "third" and the like are used in this application to aid the reader in understanding the present invention by providing a relative frame of reference and are not meant to limit the scope of the claims to any particular orientation relative to a viewer.

What is claimed is:

1. A collapsible array, comprising:

a first row of a plurality of panels foldably connected to each other in a manner permitting said plurality of panels to be folded to form a stack of panels;

a second row of a plurality of panels foldably connected to each other in a manner permitting said plurality of panels to be folded to form a stack of panels;

the leftmost panel of said first row being foldably connected to the leftmost panel of said second row in a manner permitting said folded first and second rows of panels to be folded to form a stack of panels with said folded second row of panels; and a third row of a plurality of panels foldably connected to each other in a manner permitting said plurality of panels to be folded to form a stack of panels;

the rightmost panel of said second row being foldably connected to the rightmost panel of said third row in a manner permitting said folded first and second rows of panels to be folded with said folded third row of panels to form a stack of panels;

whereby said panels of said rows are capable of being folded to form a single stack of panels.

2. A collapsible array as recited in claim 1, further comprising a fourth row of a plurality of panels foldably connected to each other in a manner permitting said plurality of panels to be folded to form a stack of panels, the leftmost panel of said third row being foldably connected to the leftmost panel of said fourth row in a manner permitting said folded first, second and third rows of panels with said folded fourth row to be folded to form a single stack of panels.

3. A collapsible array as recited in claim 1, further comprising a plurality of additional rows of panels, each of said plurality of additional rows capable of being folded to form a stack of panels, each of said plurality of additional rows having either a leftmost panel or a rightmost panel foldably connected to the corresponding leftmost panel or rightmost panel in the row below in a manner permitting all of said rows in said array to be folded into a single stack of panels.

4. A collapsible array as recited in claim 1, wherein said panels of said rows are capable of being folded to form a single stack of panels having a frontal dimension of one panel.

5. A collapsible array as recited in claim 1, wherein each of said plurality of panels is of a predetermined width and comprises a front surface, a rear surface, and peripheral edge surfaces.

6. A collapsible array as recited in claim 5, wherein each of said plurality of panels is rectangular in shape.

7. A collapsible array as recited in claim 1, wherein edge surfaces of at least two adjacent panels define at least one connecting pin channel extending into said panel such that, when said adjacent panels are unfolded, said connecting pin channels in said adjacent panels are co-axially aligned with one another.

8. A collapsible array as recited in claim 7, further comprising a plurality of pins for insertion into said coaxially aligned connecting pin channels of said adjacent panels to hold said adjacent panels in a specific orientation with respect to each other.

9. A collapsible array as recited in claim 1, wherein prong receptacles are defined in outer edge surfaces of at least two of said adjacent panels.

10. A collapsible array as recited in claim 9, wherein an indentation is formed around said prong receptacles.

11. A collapsible array as recited in claim 10, further comprising a plurality of retainers comprising a back plate and at least two prongs extending therefrom, said prongs being insertible into said prong receptacles defined in said outer edge surfaces of said panels to hold said panels in a specific orientation with respect to one another, said back plate being insertible into said indentation.

12. A collapsible array as recited in claim 9, wherein said panels of said array may be arranged so that said array is self-supporting.

13. A collapsible array, comprising:

a first row of panels comprising a leftmost panel and a rightmost panel;

a second row of panels comprising a leftmost panel and a rightmost panel and located above said first row of panels, said leftmost panel of said first row being foldably connected to said leftmost panel of said second row;

a third row of at least one panel located above said second row of panels and foldably connected to said rightmost panel of said second row, said panels in said first, second and third rows being foldable into a single stack of panels.

14. A collapsible array as recited in claim 13, wherein said third row comprises a leftmost panel and a rightmost panel, said rightmost panel of said second row being foldably connected to said rightmost panel of said third row.

15. A collapsible array as recited in claim 14, further comprising a fourth row of panels located above said third row of panels, said fourth row of panels comprising a leftmost panel and a rightmost panel, said leftmost panel of said third row being foldably connected to said leftmost panel of said fourth row.

16. A collapsible array as recited in claim 15, further comprising a plurality of additional rows of panels each comprising a leftmost panel and a rightmost panel, each row having either said leftmost panel or said rightmost panel foldably connected to a corresponding leftmost panel or rightmost panel in the row below such that said first, second, third and fourth rows and said plurality of additional rows are capable of being folded into a single stack of panels.

17. A collapsible array as recited in claim 13, wherein said rows of panels are capable of being folded into a single stack of panels having a frontal dimension of one panel.

18. A collapsible array as recited in claim 14, wherein each of said rows further comprises a middle panel foldably connected between said leftmost and rightmost panels in each of said rows.

19. A collapsible array as recited in claim 13, further comprising a plurality of panels foldably connected between said leftmost and rightmost panels in each of said rows.

20. A collapsible array as recited in claim 13, wherein each of said rows further comprises an additional panel foldably connected to said leftmost panel or said rightmost panel of at least one of said rows.

21. A collapsible array as recited in claim 13, wherein each of said rows further comprises additional panels foldably connected to said leftmost panel and said rightmost panel of at least one of said rows.

22. A collapsible array as recited in claim 13, wherein said panels are formed from a sheet of material having a core layer, a top foldable layer and a bottom foldable layer.

23. A collapsible array as recited in claim 22, wherein said panels are foldably connected by either said top layer or said bottom layer.

24. A method of manufacturing an array of panels, comprising the steps of:

providing a sheet of material;

cutting said sheet of material to form:

a first row of panels comprising a leftmost panel and a rightmost panel;

a second row of panels comprising a leftmost panel and a rightmost panel and located above said first row of panels, said leftmost panel of said first row being foldably connected to said leftmost panel of said second row;

a third row of at least one panel located above said second row of panels and foldably connected to said rightmost panel of said second row, whereby said panels in said rows may be folded into a single stack of panels.

25. A method of manufacturing an array of panels as recited in claim 24, wherein said step of providing a sheet of material comprises providing a sheet of material having a core layer, a top layer and a bottom layer, said top and bottom layers being foldable, and wherein said step of cutting said sheet of material to form said first, second and third rows comprises:

cutting one of said top and bottom layers and said core layer to form individual panels foldably connected by said top layer or said bottom layer in each of said rows; and cutting one of said top and bottom layers and said core layer to foldably connect said leftmost or said rightmost panels of adjacent rows by said top layer or said bottom layer.

* * * * *